United States Patent [19]

Guss

[11] Patent Number: 4,953,434

[45] Date of Patent: Sep. 4, 1990

[54] STRINGED MUSICAL INSTRUMENT THAT CAN BE PLAYED BY TWO MUSICIANS SIMULTANEOUSLY

[76] Inventor: Paul A. Guss, P.O. Box 15204, Arlington, Va. 22215-0204

[21] Appl. No.: 399,955

[22] Filed: Aug. 29, 1989

[51] Int. Cl.[5] ..... G10D 1/00

[52] U.S. Cl. ..... 84/263; 84/173; 84/293

[58] Field of Search ..... 84/263, 267, 291, 173, 84/293

[56] References Cited

U.S. PATENT DOCUMENTS 4,343,217 8/1982 Brody ..... 84/263 X 4,785,705 11/1988 Patterson ..... 84/263 X

*Primary Examiner*—Lawrence R. Franklin

*Attorney, Agent, or Firm*—Paul A. Guss

[57] ABSTRACT

The present invention comprises a novel stringed musical instrument that can be played by two musicians simultaneously. The instrument comprises two instrument bodies with necks mutually joined about a common central cavity such that the instrument may be flexed about a common vertex located at the center of the central cavity. In the preferred embodiment, the instrument bodies are joined about a spherical resonant cavity and are joined at the center thereof by a joint mechanism allowing angular and rotational freedom of motion for the two instrument bodies with respect to each other. The invention is particularly suited to the guitar, and allows for a plurality of sounds produced from the two guitar bodies to be simultaneously focused and combined within the central resonant cavity. Therefore two musicians can engage in the playing of duets upon a single musical instrument. The shape of the guitar bodies may be such so as to enhance the focusing of sounds produced from respective sets of guitar strings toward the common vertex. A microphone or other sound transducing element may be positioned in the central cavity at the common vertex.

17 Claims, 7 Drawing Sheets

STRINGED MUSICAL INSTRUMENT THAT CAN BE PLAYED BY TWO MUSICIANS SIMULTANEOUSLY

BACKGROUND OF THE INVENTION

The present invention relates to stringed musical instruments, for example the guitar, and more particularly to a novel type of stringed musical instrument that can be simultaneously played by two musicians. Further, the present invention allows for the sound produced by the two musicians to be combined sonically within one resonant instrument cavity. The instrument may also be flexible, and therefore allows for the two musicians to play the instrument with great ease.

By way of example, a prior art description of a conventional guitar will now be introduced with reference to FIG. 1. FIG. 1 shows a conventional guitar, although it will be appreciated that a guitar is merely one type of stringed musical instrument and that the invention described herein is not limited only to guitars but also to other similar instruments, for example the cello, the violin, viola and so on. The guitar in FIG. 1 generally comprises a body 10 showing a front panel 11 and a back panel 12. In the front panel 11 there is included a sound hole 13. Attached to the body is a substantially rectangular neck 14 with a fretboard 15 contained thereon. The fretboard 15 extends over the length of the neck 14 and also extends onto the body portion of the top piece 11 from the neck 14 extending approximately to the location of the sound hole 13. On the fretboard 15 there are included a certain number of frets 16, usually being from 19 to 27 in number. On the end of the neck opposite from the guitar body there is shown a tuning mechanism 17, known as the headstock, with a series of tuning pegs 18 included thereon. The tuning pegs 18 in turn engage a surface about which a series of strings 19 are wound such that the tension of the respective strings may be adjusted for tuning the instrument. Often the number of strings on a conventional guitar is six, although the number may vary to be more or less than six. Also shown at the end of the guitar is a piece referred to as the "nut" 20 being located just next to the tuning mechanism and over which the strings 19 ride. The strings then extend from the nut 20, over the neck and sound hole, to the bridge 21.

A known variation of the conventional guitar described above is shown in FIG. 2. Such a guitar was invented by the Japanese musician Hideyuki Ezaki and is disclosed in U.S. Pat. No. 3,636.809. The guitar is essentially a mirror symmetrical version of the conventional guitar shown in FIG. 1, wherein the guitar is symmetrical about its longitudinal plane P. Two necks 22 and 23 are shown extending in a back to back relation. The instrument further includes two sound holes 24 and 25 positioned on opposite sides of the guitar body. As well, two tuning mechanisms 26 and 27 are shown, also in back to back relation. As can be understood from this example, the guitar of Ezaki allows for a plurality of sounds to be produced by one instrument. However, only one musician is intended to play this instrument at a time. For example, the guitar will be held in the lap of the musician so that he or she could play only one side of the guitar at a time. To produce a variety of sounds, the musician would then have to flip the guitar in the lap and then play the other side of the guitar. It will also be appreciated that as the guitar is held by the musician, the strings facing the abdomen of the musician would likely be muted by contact with the person's body. Therefore, only one set of strings can actually be played at a time, and a plurality of sounds produced from the respective sets of strings cannot be simultaneously produced in the resonant cavity of the guitar.

SUMMARY OF THE INVENTION

The present invention comprises a novel stringed musical instrument that can be played by two musicians simultaneously. The instrument comprises two guitar bodies, or the like, with necks mutually joined about a common vertex such that the instrument may be flexible about the vertex. In the preferred embodiment, the instrument bodies are joined about a spherical resonant cavity and joined at the center thereof by a joint mechanism allowing angular and rotational freedom of motion of the two guitar bodies with respect to each other, wherein the instrument is flexible within three dimensions and may be played by two musicians with ease. The invention allows for a plurality of sounds to be simultaneously produced within the resonant cavity. Therefore, two musicians can engage in the playing of duets upon a single musical instrument. Further, the instrument may comprise a sound focusing capacity wherein the sounds produced by the individual sets of strings may be simultaneously combined by the shape of the guitar bodies to result in a pleasing combinatory effect of musical notes.

DETAILED DESCRIPTION OF THE INVENTION

Figure 1:
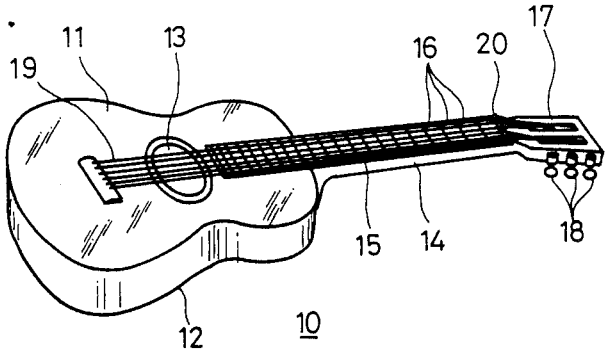
FIG.1 PRIOR ART
FIG. 1 conventional guitar including a resonant body with a neck attached thereto.
Figure 2:
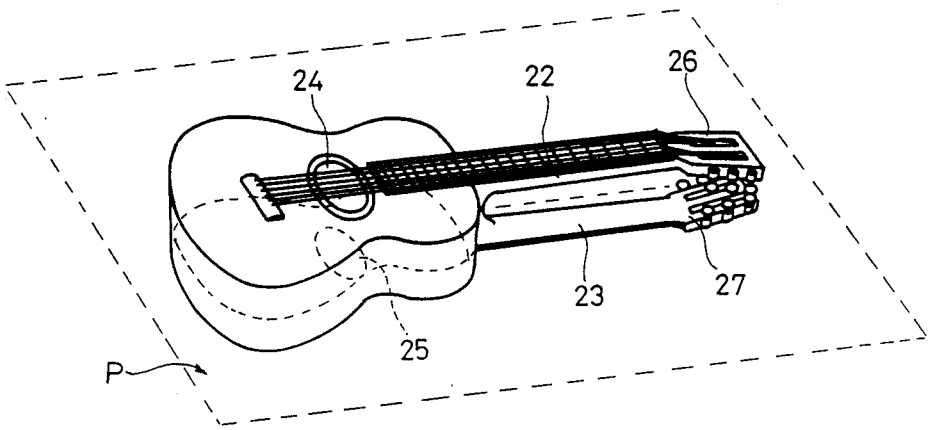
FIG.2 PRIOR ART
FIG. 2 variation of the guitar shown by FIG. 1 wherein two guitar bodies are joined in a back to back relation about a common longitudinal plane.
Figure 3:
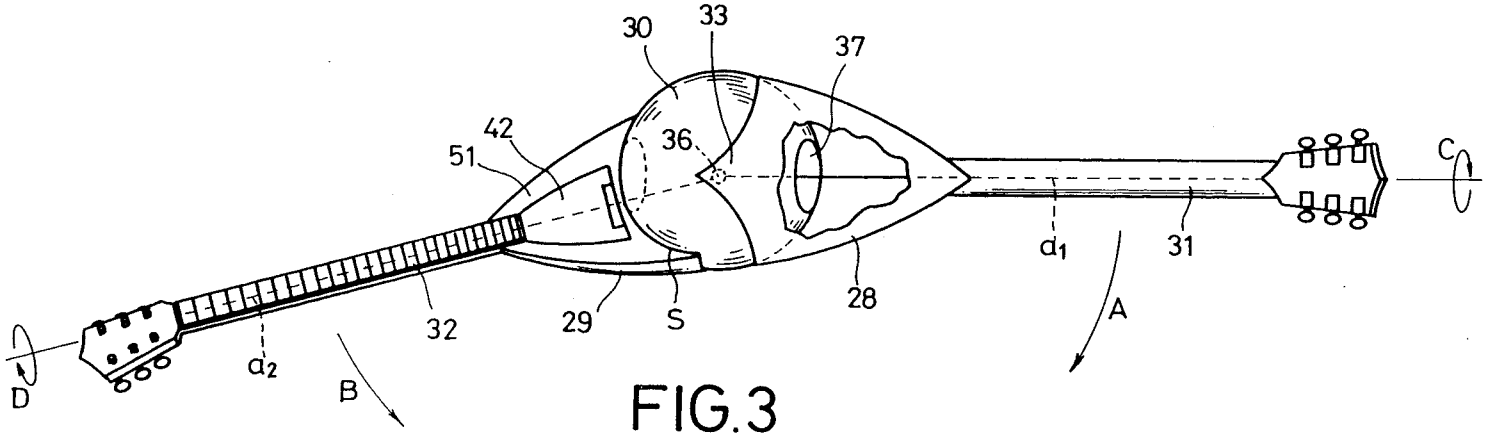
FIG. 3 shows a preferred embodiment of the present invention, wherein two guitar bodies are joined about a central spherical cavity, and wherein the necks of the guitar bodies are joined about a common vertex by a joint mechanism.

The present invention comprises a type of musical instrument with two guitar bodies joined about a common vertex. The most preferred embodiment is shown in FIG. 3. Therein is shown two guitar bodies 28 and 29 joined about a centrally located sphere 30. The bodies are positioned such that the necks 31 and 32 of the guitar bodies extend in more or less opposite directions from the central vertex 33 along axes $a_1$ and $a_2$. The necks 31,32 are of common construction, including frets and having strings positioned thereon. The guitar bodies 28 and 29 generally include all of those elements which would be included on a guitar, including the bridge, nut, tuning mechanism, tuning pegs and so on.

More particularly, FIG. 3 shows a guitar comprising two instrument bodies 28 and 29 and two necks 31 and 32 wherein a longitudinal axis of a first neck 31 defines a first axis $a_1$ and a longitudinal axis of a second neck 32 defines a second axis $a_2$. The instrument further comprises means for positioning the guitar bodies 28,29 such that the first and second axes intersect with a common central vertex 33.

Figure 4:
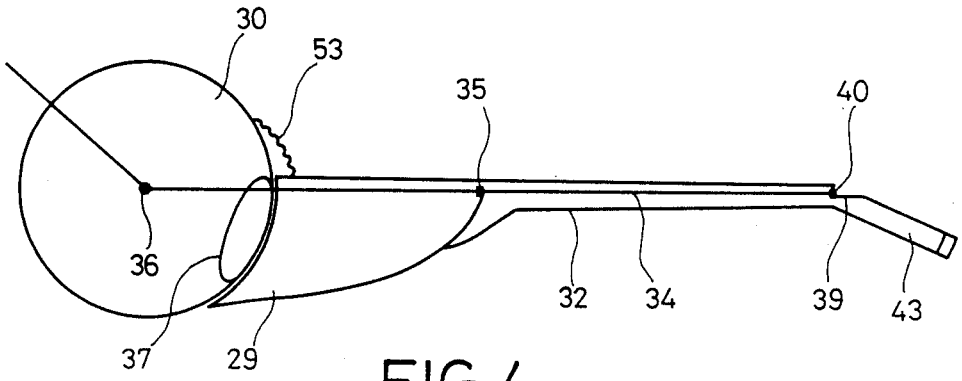
FIG. 4 shows a detail of the neck and body construction of the guitar shown in FIG. 3.

In the necks 31,32 there are located along axes $a_1$ and $a_2$ longitudinally extending tension rods 34 extending through the length of the necks and being joined and extending to a first threaded portion wherein the tension rods 34 engage a nut 35 (see FIG. 4). From the first threaded portion the tension rods extend to a position where they join at a common vertex 33 located between the guitar bodies 28 and 29. At the common vertex 33 there is located a joint mechanism 36 for joining the two tension rods 34 of the two respective guitar bodies. The guitar bodies are joined as shown about a common spherical resonant cavity 30. In the spherical cavity are included cutout sections 37 comprising a surface section cut out of the surface of the spherical resonant cavity 30. Such cutouts may comprise a circular surface section cut out from diametrically opposed sides of the spherical cavity 30. Therefore, the cutouts 37 define a conical region within which the tension rods 34 may freely move, and also restrict the movement of the rods 34 within the conical region. The tension rods 34 extend through the spherical cavity 30 from the common central vertex 33 to the respective ends of the necks wherein is included in the headstock 43 a beveled portion 39 (FIG. 4) including yet another nut 40 for holding the tension rods at the respective ends of the guitar necks.

It will be noted that the spherical surface cutout sections 37 also provide the feature of limiting the motion of the guitar bodies such that, for example, were the guitar on the right hand side of FIG. 3 to be swung clockwise as shown by arrow A, the tension rod 34 would eventually come into contact with the wall of the cutout section so as to limit the motion of the guitar body 29 in this direction relative to the guitar body 28.

The guitar bodies 28 and 29 each include two more or less bowl shaped resonant cavities wherein such resonant cavities are held into movable contact with the central sphere by virtue of the joint mechanism 36. At the contact point between the two guitar bodies and the spherical cavity there is provided a slidable surface (for example, Teflon, graphite or a ball bearing arrangement) so that the guitar bodies may freely move about the spherical surface. On the top 51 of the guitar bodies there may be included a membrane or diaphragm 42 that serves to impel the sound produced by the strings in the direction of the bowl shaped cavites so that the sound produced by the two guitars can be simultaneously combined inside the spherical resonant cavity 30 to produce the pleasing combinatory effect of musical notes.

By virtue of the joint mechanism 36, the guitar bodies can be rotated and swung in many directions with respect to each other. For example, the guitar body on the right hand side of FIG. 3 can be rotated in a clockwise direction as shown by arrow C and the guitar on the left hand side of the figure can be rotated in a counterclockwise direction as shown by the arrow D, and vice versa. Further, the movement of the two necks may be as shown by arrows A and B such that the guitars can be flexed in that direction and also in the direction opposite to the arrows. Therefore, it will be appreciated that the guitar of the present invention can assume many positions and may be easily held by two musicians while playing wherein both musicians may engage in a combinatory musical effect producing a pleasing combination of sounds within the spherical resonant cavity 30.

It should be further understood that the common vertex 33 is the focus of sound of the sounds produced by the two guitar bodies. Therefore, a microphone or other sound transducing device may be positioned at the vertex 33 of the instrument.

The bowl like shape of the guitar bodies 28 and 29 may assume a more or less ellipsoidal or parabolic configuration, or shapes of other conic sections, which will also serve to enhance the focusing of the sound from the guitar bodies.

FIG. 4 shows an orthogonal view in schematic form of a detail of the construction of the guitar shown in FIG. 3, only one of the guitar bodies (29) being shown. Throughout the length of the guitar body is included a longitudinally disposed tension rod 34. From the headstock 43 of the guitar neck 31 there is included a first beveled portion 39 housing a first nut 40. The first nut is threadedly engaged with one end of the tension rod 34. The tension rod then extends through the length of the neck 31 where it threadedly engages a second nut 35 at a point near to where the neck joins with the guitar body 28. The tension rod 34 continues to extend through the guitar body into the spherical cavity 30, the tension rod entering the spherical cavity by way of the spherical surface cutout section 37. The tension rod at the center of the spherical cavity 30 joins with another tension rod by means of the joint mechanism 36. The second tension rod extends in a substantially opposite direction from the first guitar body through a similar spherical section surface cutout and continues through the second guitar body 28 (FIG. 3) in a similar fashion as in the first guitar body 29.

As is known in guitar construction, typically a tension rod is disposed within the neck of the guitar for adjusting the "bow" and "bend" of the neck in order to assure that the neck is substantially straight and plane with the body of the guitar. Typically the tension rod will extend through the length of the neck from an area where the neck joins with the body of the guitar to the headstock. However, in the present invention, departing from the prior art practice, the tension rod 34 is constructed as a unitary structure which goes not only through the neck of the guitar but also through the guitar body. Two threaded portions are included on the tension rod at the positions of nuts 40 and 35. Therefore, the tension rod of the present invention allows for the neck to be fully adjustable in a manner consistent with the prior art. However, the tension rod also extends and joins with another tension rod, allowing for the advantageous feature of providing a guitar that can be happily played by two interacting musicians. The tension rod also provides for a structurally sound and sturdy construction for the two guitar bodies and allows the two bodies to be movable about the spherical resonant cavity.

The guitar bodies 28 and 29 should be constructed so as to fit around the spherical cavity 30 in a manner such that, when the guitars are moved within the limits allowed by the spherical surface section cutouts 37, the cutouts will never become exposed. For example, on the bottom portion of the face 51 of the guitar bodies there may be provided a flange that extends so as to cover the cutout at all times as the guitar bodies are moved. Or, there may be provided a skirt 53 attached about the bottom portion of the face 51 of the guitar body, such as shown schematically in FIG. 3.

Figure 5A:
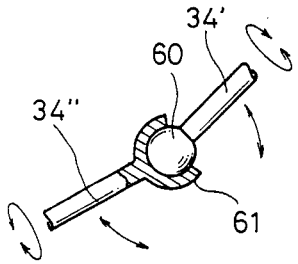
FIGS. 5A through 5C show possible joint mechanisms for use with the present invention.
Figure 5B:
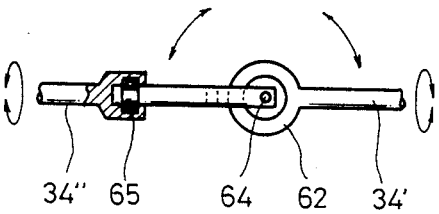
Figure 5C:
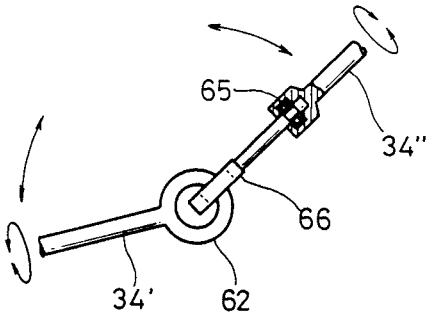

FIGS. 5A through 5C show some possible arrangements for the joint mechanism to be used in the embodiment of FIG. 3. Generally, the joint mechanism must be one allowing angular movement between the tension rods and also allowing freedom of rotation for each tension rod. FIG. 5A shows a ball and socket joint wherein one of the tension rods 34' (which may be either rod) terminates in a ball 60 and the other tension rod 34" terminates in a socket 61 surrounding the ball 60 while allowing movement of the same in the direction of the arrows. FIG. 5B shows a joint wherein one of the tension rods 34' terminates in a ring 62. The ring 62 is in turn engaged by a link 63 about an axle 64. The link in turn engages with tension rod 34" and is held in the same with ball bearings 65. In FIG. 5C one of the tension rods 34' terminates in a ring 62 wich is interlinked with another ring 66. The second ring engages with the other tension rod 34" and is rotatably held in the same by ball bearings 65. In FIGS. 5B and 5C the tension rods are also allowed rotational and angular freedom of motion so as to allow the guitar bodies and necks to move as described above in relation to FIG. 3. In FIGS. 5B and 5C ball bearings may be provided on either of the rods 34',34" or both rods if so desired.

It is contemplated that the construction of the guitar bodies and the spherical cavity may be formed in a manner known in the prior art and particularly utilized by Ovation Guitars. U.S. Pat. No. 3,474,697 to Kaman describes such a technique of guitar construction wherein a generally parabolic or bowl shaped body is formed from plies of glass fiber impregnated with epoxy resin and laminated to a certain thickness. The impregnated fabric construction is formed into the shape of the guitar body. The present invention can be fabricated by such known processes wherein the spherical cavity 30 and the backs of the guitar bodies 28 and 29 can be formed out of such impregnated fabric plies. The top piece or face 51 of the guitar should preferably be made of wood to enhance the appearance and tonal quality of the instrument. The face 51 may also include a resonant membrane 42 thereon to enhance the resonance and focusing of sound in the instrument, but such a membrane is not required.

It will further be appreciated that the construction of the guitar bodies and spherical cavity is not limited to the above described technique, but may also comprise materials, such as plastics and/or fiberglass, as would be understood by those skilled in the art.

It should further be understood that the above-described construction is not limited to any one type of joint mechanism, and that such a joint mechanism may be eliminated, thus providing a rigid attachment of the guitar bodies 28, 29 about the central sphere 30. Furthermore, the bodies may be slidably or detachably connected to the central sphere 30 without the necessity for the tension rods 34 to extend into the central sphere. For example, the bodies 28, 29 might be attached to slide about the sphere, or to be detachably fitted to the central sphere 30, by other known mechanical means which would be apparent to ordinary craftspersons. Also, the axes $a_1$ and $a_2$ need not intersect exactly at the center of the sphere, but may be substantially directed to converge toward a central region of the sphere 30.

Additional embodiments of the present invention will now be described with reference to FIGS. 6 and 7.

Figure 6:
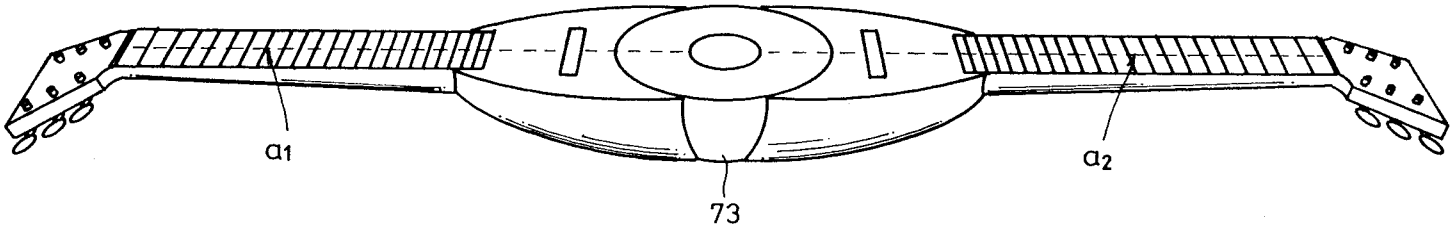
FIG. 6 shows another embodiment of the present invention.

FIG. 6 shows a construction of the guitar of the present invention wherein the spherical cavity is replaced by a semi-sphere 73. The two guitar bodies are joined about the semi-sphere and extend in substantially opposite directions therefrom along axes $a_1$ and $a_2$. The construction of the FIG. 6 embodiment is quite similar to the construction of the embodiment shown in FIG. 3, insofar as the instrument bodies are positioned such that necks 74 and 75 can be moved with rotational and angular freedom about the central cavity. However, the guitar of FIG. 6 must be played by two oppositely handed musicians. For example, when held by two musicians, the guitar as well as the two musicians would necessarily be facing in the same direction. As a result, the musician on the right would hold the right neck 74 with the right hand whilst the musician on the left would play the neck 75 with the left hand. Therefore, the instrument of FIG. 6 is not nearly so versatile as the instrument described in FIGS. 3 and 4. Of course, the present embodiment may also possess all of the features of the previous embodiment, including but not requiring a resonant membrane (42, FIG. 3). Also, the shape of the guitar body may be roughly ellipsoidal or parabolic, or shapes of other conic sections, for the purpose of effectively focusing the sound of the two guitar bodies within the semi-spherical cavity.

Figure 7:
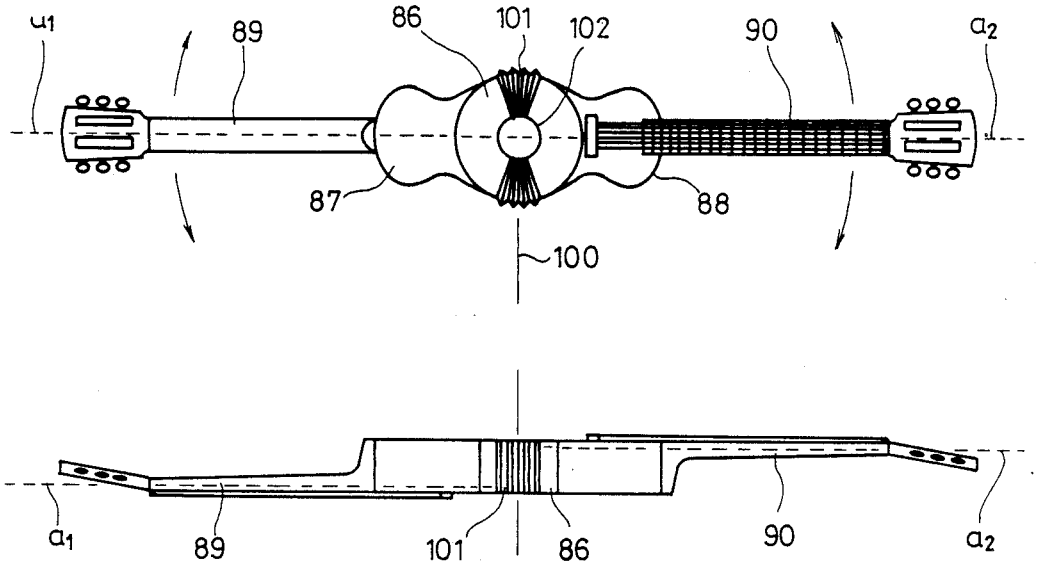
FIG. 7 shows still another embodiment of the present invention.

The embodiment shown by FIG. 7 is more closely in the nature of a conventional guitar. In this embodiment, two guitar bodies 87 and 88 are joined about a center portion 86 roughly in the shape of a cylinder. The guitar bodies 87,88 and necks 89,90 extend in substantially opposite directions and may be pivoted about a central axis 100 by means of, for example, a bellows construction 101.

In this embodiment, when viewed as in the upper half of FIG. 7, the axis 100 is seen as a point located in the center of the sound hole 102. Such a point may be considered as a central vertex about which the axes $a_1$ and $a_2$ are angularly movable with respect to each other in the directions shown by the arrows. However, in the present embodiment, rotational movement of the axes $a_1$ and $a_2$ about the central vertex is not possible.

It is also possible to omit the pivot means altogether, thus providing an instrument of rigid construction with the two necks extending in directly opposite directions. However, such a construction may result in the instrument being more difficult to play by two musicians since the orientation of the guitar bodies could then not be adjusted to suit the comfort of the two players.

As for the FIG. 7 embodiment, the instrument as shown is intended to be played by two like handed musicians. As may be understood from the figure, the musicians holding the instrument would be facing in opposite directions wherein the instrument could only be played by two right handed or two left handed persons. It will also be appreciated that the guitar of FIG. 7 can be constructed with both necks 89 and 90 facing in the same direction such that the guitar could then be played by two differently handed musicians. Again, the instrument of FIG. 7 is not quite so versatile as the instrument described in relation to FIGS. 3 and 4. Also, if desired, the bodies of the instrument may be shaped with backs to be roughly ellipsoidal or parabolic in shape, or shapes of other conic sections, for the function of focusing the sound produced by the two guitar bodies toward the sound hole 102.

Figure 8:
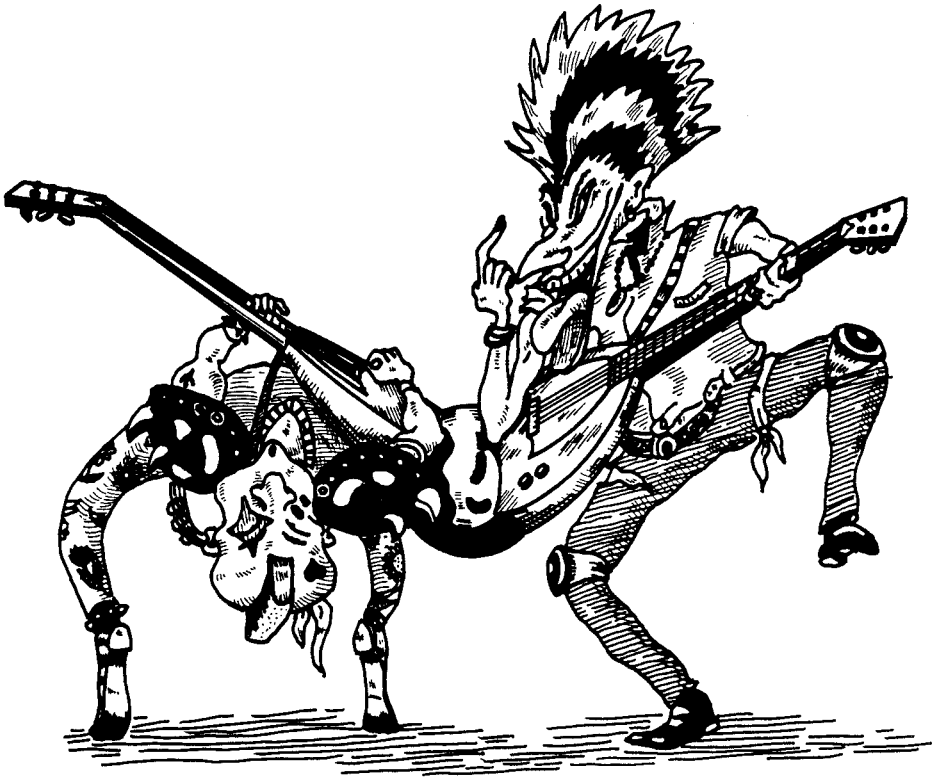
FIG. 8 shows the preferred embodiment of the invention shown in FIG. 3 as being played by two musicians in a variety of positions and orientations.

Returning now to the most preferred embodiment, FIG. 8 shows the guitar of the present invention while being played by two musicians. The musicians appear in various positions and orientations. The guitar can assume a variety of positions due to its unique flexibility about the central vertex by virtue of the joint mechanism. Since the guitar effectively provides a common vertex about which the two musicians can freely swing and twist, the guitar of the present invention is particularly suited to be played in regions of zero gravity. With the advent of modern space travel, it is to be expected that this instrument will find great utility as a means for providing entertainment and amusement for space traveling musicians of the future.

Herein has been described a unique stringed musical instrument that can be played by two musicians simultaneously. As has been understood from reading the present specification, the instrument of the invention possesses many advantages both for enhancing the interaction between musicians and for producing a pleasing combinatory effect of musical notes within one resonant sound cavity.

Obviously, many additions and modifications can be made to the present invention without departing from the scope of the invention described herein. Accordingly, the drawings and description are not to be construed as defining or limiting the scope of patent protection sought by the inventor, as such is the purpose of the appended claims.

What is claimed:

1. A stringed musical instrument comprising:
two instrument bodies; and
two necks, wherein a longitudinal axis along a first neck defines a first axis and a longitudinal axis along a second neck defines a second axis; and
means for joining and for positioning said instrument bodies and said necks such that said first and second axis substantially intersect with a common vertex located between said instrument bodies and said first and second axes are at least angularly movable with respect to each other about said common vertex.

2. A stringed musical instrument according to claim 1, further comprising tension rods associated with each of said first and second necks being disposed substantially along said first and second axes.

3. A stringed musical instrument according to claim 2, further comprising joint means positioned at said common vertex for allowing rotational and angular freedom of movement between said tension rods, wherein said tension rods are joined at said common vertex by said joint means.

4. A stringed musical instrument according to claim 3, wherein said tension rods each comprise two threaded portions thereon and further comprising nuts engaging said threaded portions for adjusting the tension of said necks.

5. A stringed musical instrument according to claim 3, further comprising a central cavity about which said two instrument bodies are positioned.

6. A stringed musical instrument according to claim 5, wherein said central cavity comprises a sphere with two cutout sections provided therein, wherein said tension rods extend through said cutout sections and are joined at said joint means located at the center of said sphere.

7. A stringed musical instrument according to claim 1, further comprising a central cavity about which said two instrument bodies are positioned.

8. A stringed musical instrument according to claim 7, wherein said central cavity comprises a hemi-sphere.

9. A stringed musical instrument according to claim 7, wherein said central cavity substantially comprises a cylinder about which said instrument bodies are positioned.

10. A stringed musical instrument according to claim 9, wherein said instrument bodies and said axes are angularly movable about said common vertex by means of a bellows.

11. A stringed musical instrument according to claim 1, further comprising a sound transducing means positioned at said common vertex for picking up the sound produced by said two instrument bodies.

12. A stringed musical instrument comprising:
two instrument bodies;
two necks, wherein a longitudinal axis along a first neck defines a first axis and a longitudinal axis along a second neck defines a second axis; and
a central cavity;
means for securing said instrument bodies about said central cavity wherein said necks and said first and second axes extend in substantially opposite directions from each other.

13. A stringed musical instrument according to claim 12, wherein said means for securing comprises joint means for movably positioning said instrument bodies about said central cavity.

14. A stringed musical instrument according to claim 12, wherein said central cavity comprises a sphere.

15. A stringed musical instrument according to claim 12, wherein said central cavity comprises a cylinder.

16. A stringed musical instrument according to claim 12, wherein said instrument bodies are positioned such that said first and second axes substantially intersect with a common vertex located at the center of said central cavity.

17. A stringed musical instrument according to claim 16, wherein said instrument bodies include a substantially bowl-shaped back portion and where the shape of said back portion serves to focus the sound produced from the respective instrument bodies in the direction of said central cavity and said common vertex.

* * * * *